United States Patent [19]

Shibahara et al.

[11] Patent Number: 4,680,253

[45] Date of Patent: Jul. 14, 1987

[54] COLOR PHOTOGRAPHIC MATERIAL

[75] Inventors: Yoshihiko Shibahara; Hideto Ikoma, both of Minami-Ashigara, Japan

[73] Assignee: Fuji Photo Film Co., Ltd., Kanagawa, Japan

[21] Appl. No.: 832,707

[22] Filed: Feb. 25, 1986

[30] Foreign Application Priority Data

Feb. 26, 1985 [JP] Japan ..... 60-37117

[51] Int. Cl.[4] ..... G03C 1/10; G03C 7/26; G03C 1/46

[52] U.S. Cl. ..... 430/504; 430/503; 430/506; 430/599; 430/604

[58] Field of Search ..... 430/503, 504, 599, 604

[56] References Cited

U.S. PATENT DOCUMENTS 3,672,898 6/1972 Schwan et al. ..... 430/507

OTHER PUBLICATIONS

James, *The Theory of the Photographic Process,* 4th Ed. Macmillan Publishing Co., Inc., New York, ©1977, pp. 139–142.

*Primary Examiner*—Richard L. Schilling

*Attorney, Agent, or Firm*—Burns, Doane, Swecker & Mathis

[57] ABSTRACT

A silver halide color photographic material which comprises a support having coated thereon at least one blue-sensitive silver halide emulsion layer, at least one green-sensitive silver halide emulsion layer and at least one red-sensitive silver halide emulsion layer, characterized in that the gradation of each of the blue-, green- and red-sensitive layers satisfies the following relation:

$$\frac{\gamma_B(10^{-4})}{\gamma_B(10^{-2})} < \frac{\gamma_G(10^{-4})}{\gamma_G(10^{-2})} \leqq \frac{\gamma_R(10^{-4})}{\gamma_R(10^{-2})} < 0.99$$

wherein $\gamma_B(10^{-4})$, $\gamma_G(10^{-4})$ and $\gamma_R(10^{-4})$ represent gradation of the blue-, green- and red- sensitive layers upon 1/10,000 second exposure, respectively and $\gamma_B(10^{-2})$, $\gamma_G(10^{-2})$ and $\gamma_R(10^{-2})$ represent those upon 1/100 second exposure, respectively, which provides a color picture having good color and tone reproduction in both regular and flash photography.

7 Claims, 3 Drawing Figures

COLOR PHOTOGRAPHIC MATERIAL

BACKGROUND OF THE INVENTION

1. Field of the Invention

This invention relates to color photographic materials and in particular to color negative photographic materials which provide a color image having improved color reproduction and tone reproduction upon exposure of the materials to either ambient light (such as daylight) or electronic flash light (strobe light).

2. Description of the Prior Art

Recently, demands for color negative photographic materials having better photographic properties has become stronger and in particular much better improvement in color reproduction and tone reproduction is desired. With the popularization of the strobe and cameras with a built-in strobe, opportunities for taking photographs using strobe light, i.e. electronic flash light have increased, and therefore a strong desire has arisen for a color negative photographic material which provides a color image having excellent color reproduction and tone reproduction.

When color negative photographic materials of the prior art are used to take photographs using electronic flash light, the following problems concerning color image quality arise: First, the color film does not reproduce colors as the eye sees them and a printed paper obtained from the negative film appears bluish. Second, the tone of the image is hard, and the tone of a human face, which is considered to be very important, is not adequately reproduced. Sometimes, delicate shadows on an object such as the face become entirely whitish (so-called "blow out") on the color print.

It is considered that the first problem is due to the high color temperature of flash light. For example, FIG. 1 shows energy distributions of flash light of the built-in strobe within a camera (AUTOBODY (trademark) produced by CANON) and daylight in fine weather. As seen from FIG. 1, flash light is high in blue light energy component and low in red light energy component as compared with daylight. Therefore, a negative film upon exposure to flash light provides a color print having color balance inclined to bluish and cyanish color as compared with that provided upon exposure to daylight.

It is generally known in the art of color photographic materials that the spectral sensitivities of blue, green and red sensitive layer can be brought near to each other in order to decrease the dependency on light-source color temperature. However, it is undesirable to bring the spectral sensitivity near to each other because color saturation is lowered.

It is considered that the second problem is due to the fact that the strobe is nearly a point light source which increases the difference in color density between light and dark areas in the object, and therefore the tone of a picture on the film appears hard. Tone reproduction can be softened by decreasing gradation of light-sensitive materials. But such lightsensitive materials provide a too soft, or undesirable "dull" picture, when used for photographing without electronic flash light, including photographing under ambient light of cloudy or rainy days.

The inventors of this invention studied ways to overcome these problems inherent in taking flash pictures. They found that natural color reproduction and excellent tone reproduction can be accomplished in flash light photography without impairing the picture quality obtained in ambient light photography (i.e. regular photography) by finely controlling the high-intensity reciprocity failure of each light-sensitive layer of a color negative film. First, it is necessary to make the high-intensity reciprocity failure of each light-sensitive layer larger by the desired degree. By this means, it is possible to soften picture gradation upon high-intensity short-time exposure such as in flash photography and to realize excellent tone reproduction, with hard picture gradation in regular photography being maintained at the desired degree. Second, it is essential to make the high-intensity reciprocity failure of the blue sensitive layer larger than that of the green sensitive layer and that of the red sensitive layer smaller than that of the green sensitive layer. By this, it is possible to compensate the deviation of color balance due to the high color temperature of flash light and consequently to obtain natural color reproduction in flash photography.

Extensive studies on high-intensity reciprocity failure characteristics of silver halide light-sensitive materials have been reported. There is described in "The Theory of the Photographic Process", 4th ed. pp. 140–142 edited by T. H. James that the high-intensity reciprocity failure could be controlled by the halide composition, pH and pAg of silver halide emulsion, chemical sensitizer, etc. However, it has never been described or suggested that it will be possible to impart suitability for flash photography to a color negative light-sensitive material by finely controlling the high-intensity reciprocity failure of each light-sensitive layer of the material in light of the characteristics of flash light previously described.

SUMMARY OF THE INVENTION

An object of this invention is to provide a color negative light-sensitive material which provides a color image with excellent color and tone reproduction in both regular and flash photography.

The object of this invention can be accomplished by a silver halide color photographic material which comprises a support having coated thereon at least one blue-sensitive silver halide emulsion layer (i.e. layer unit), at least one green-sensitive silver halide emulsion layer and at least one red-sensitive silver halide emulsion layer, characterized in that the gradation of each of the blue-, green- and red-sensitive layers satisfies the following relation:

$$\frac{\gamma_B(10^{-4})}{\gamma_B(10^{-2})} < \frac{\gamma_G(10^{-4})}{\gamma_G(10^{-2})} \leqq \frac{\gamma_R(10^{-4})}{\gamma_R(10^{-2})} < 0.99$$

wherein $\gamma_B(10^{-4})$, $\gamma_G(10^{-4})$ and $\gamma_R(10^{-4})$ represent gradation of the blue-, green- and red-sensitive layers upon 1/10,000 second exposure, respectively and $\gamma_B(10^{-2})$, $\gamma_G(10^{-2})$ and $\gamma_R(10^{-2})$ represent those upon 1/100 second exposure, respectively.

DETAILED DESCRIPTION OF THE INVENTION

Figure 1:
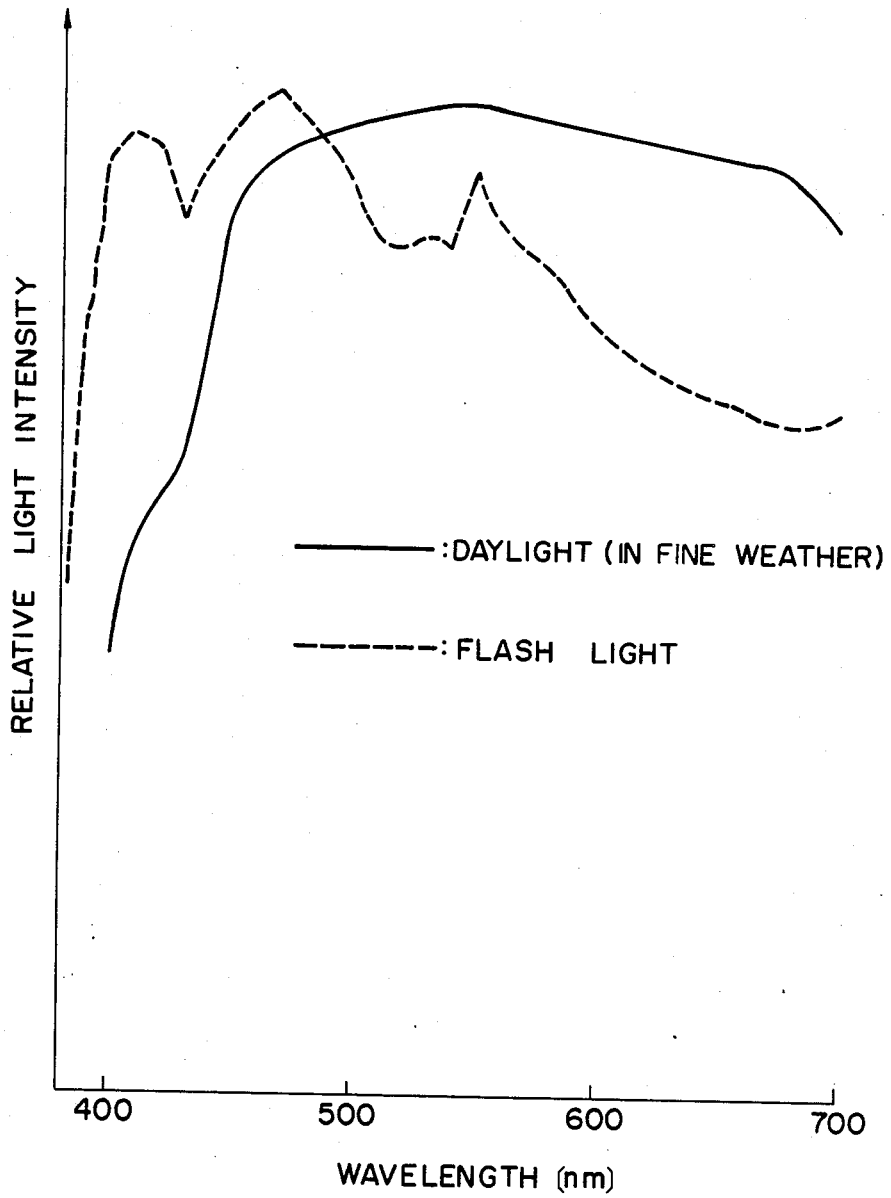
FIG. 1 shows the energy distribution of electronic flash light and of daylight.
Figure 2:
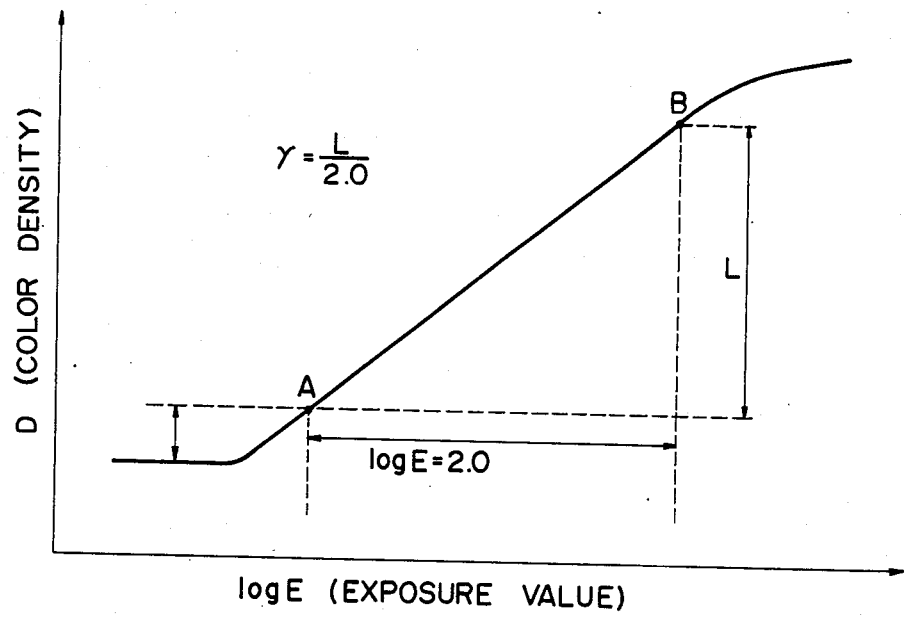
FIG. 2 shows a graph for explaining the definition of "(average) gradation" (gamma) used in this specification and FIG. 3 shows color balance appearing on the print of a neutral gray plate obtained by flash light photography.

Gradation is defined as the slope of the straight-line portion AB of the characteristic curve as shown in FIG. 2 wherein color density D is plotted against the logarithm of the exposure E, the point A corresponding to 0.2 density above fog and the point B lies 2.0 log units from point A in the direction of greater exposure.

Exposure of 1/100 and 1/10,000 second is conducted by SENSITOMETER MARK IV produced by EG & G Co.

Preferably, $\gamma_G(10^{-4})/\gamma_G(10^{-2})$ and $\gamma_R(10^{-4})/\gamma_R(10^{-2})$ satisfy the following relation:

$$\frac{\gamma_G(10^{-4})}{\gamma_G(10^{-2})} < \frac{\gamma_R(10^{-4})}{\gamma_R(10^{-2})}$$

In a preferred embodiment of this invention, the ratio of gradation of each of the blue-, green- and red-sensitive layers upon 1/10,000 second exposure to those upon 1/100 second exposure respectively satisfies the following relation:

$$0.85 < \gamma_B(10^{-4})/\gamma_B(10^{-2}) < 0.96$$

$$0.87 < \gamma_G(10^{-4})/\gamma_G(10^{-2}) < 0.98$$

$$0.89 < \gamma_R(10^{-4})/\gamma_R(10^{-2}) < 0.99$$

By controlling the high-intensity reciprocity failure as described above, it is possible to realize a photographic material which provides a picture with excellent tone reproduction, the gradation of which is softened only upon high-intensity short time exposure in flash photography.

In a more preferred embodiment of this invention, the ratio of gradation of each of the blue-, green- and red-sensitive layers upon 1/10,000 second exposure to those upon 1/100 second exposure respectively satisfies the following relation:

$$0.87 < \gamma_B(10^{-4})/\gamma_B(10^{-2}) < 0.92$$

$$0.89 < \gamma_G(10^{-4})/\gamma_G(10^{-2}) < 0.94$$

$$0.91 < \gamma_R(10^{-4})/\gamma_R(10^{-2}) < 0.96$$

In another more preferred embodiment of this invention, the ratio of gradation of each of the blue-, green- and red-sensitive layers upon 1/10,000 second exposure to those upon 1/100 second exposure satisfies the following relation:

$$0.92 < \frac{\gamma_B(10^{-4})}{\gamma_B(10^{-2})} / \frac{\gamma_G(10^{-4})}{\gamma_G(10^{-2})} < 0.99$$

$$1.01 < \frac{\gamma_R(10^{-4})}{\gamma_R(10^{-2})} / \frac{\gamma_G(10^{-4})}{\gamma_G(10^{-2})} < 1.08$$

By regulating the high-intensity reciprocity failure as described above, it is possible to automatically compensate the deviation of color balance due to the high color temperature of an electronic flash light source and to thereby realize a photographic material which can provide a picture with natural color reproduction both in regular and electronic flashphotography.

Another method for compensating the deviation of color balance due to the high color temperature of an electronic flash light source is to decrease the speed upon 1/10,000 second exposure as compared with that upon 1/100 second exposure rather in the green-sensitive unit than in the red-sensitive unit, and rather in the blue-sensitive unit than in the green-sensitive unit. In this method, gradation of each of the blue-, green- and red-sensitive units is not changed but the high-intensity reciprocity failure is regulated with respect to relative speed of each of the color-sensitive units.

In a still more preferred embodiment of this invention, the ratio of gradation of each of the blue-, green- and red-sensitive layers upon 1/10,000 second exposure to those upon 1/100 second exposure respectively satisfies the following relation:

$$0.95 < \frac{\gamma_B(10^{-4})}{\gamma_B(10^{-2})} / \frac{\gamma_G(10^{-4})}{\gamma_G(10^{-2})} < 0.98$$

$$1.02 < \frac{\gamma_R(10^{-4})}{\gamma_R(10^{-2})} / \frac{\gamma_G(10^{-4})}{\gamma_G(10^{-2})} < 1.05$$

The high-intensity reciprocity failure of each of the light-sensitive layers can be regulated by a change in the high-intensity reciprocity failure of the light-sensitive silver halide emulsion incorporated in each of the light-sensitive layers.

"A change in the high-intensity reciprocity failure of the light-sensitive silver halide emulsion" may be either a change in the gradation or a change in speed of the silver halide emulsion depending upon the intensity of illumination (irradiance). For example, softening of the tone of a certain color-sensitive unit (B, G or R) can be realized by the use of at least one emulsion in the color-sensitive unit which provides smaller gradation upon high-intensity or at least one emulsion in the color-sensitive unit, which provides slower speed upon high-intensity. In a case where the latter method is applied, it is desirable that the color-sensitive unit comprises two or more layers (i.e. subunits) which are different in speed, and that the lower the emulsion speed, the greater the extent of reduction in speed upon high-intensity, so that smooth overall gradation is realized. Another method for softening the tone of a certain color-sensitive unit upon high-intensity is to increase the speed upon high-intensity of an emulsion having gradation in a higher speed area. It is preferred that at least one of the blue-, green- and red-sensitive units comprises three layers which are different from each other in speed, so that smooth overall gradation is realized. Still another method for softening the tone of a certain color-sensitive unit upon high-intensity is to decrease the maximum density (Dmax) of the corresponding characteristic curve upon high-intensity or to solarize the highest-density bearing emulsion upon high-intensity.

The method for regulating the high-intensity reciprocity failure of an emulsion is not restricted to any particular one. For example, it is possible to make the high-intensity reciprocity failure of an emulsion larger by increasing the amount of sulfur sensitizer in a chemical ripening step of the emulsion preparation, while it is possible to make it smaller by adding $Ir^{4+}$ ion in an amount of 0.001–0.1 mole % based on the amount of silver halide to the emulsion in a precipitation forming step of the emulsion preparation.

It is more important to regulate the high-intensity reciprocity failure of lower speed layer than to regulate that of the highest speed layer, if a color-sensitive layer comprises two or more layers which are different in speed. This is because the exposure value is usually higher in electronic flash photography than in regular photography.

In this invention, various color couplers can be used, typical examples of which are cyan, magenta and yellow dye forming couplers as described in the patent specifications cited in *Research Disclosure,* Item No. 17643, (December, 1978), VII-D and Item No. 18717, (November, 1979). These couplers are preferably those having been rendered nondiffusible by the introduction of ballast group or by dimerization or polymerization and may be either four- or two-equivalent couplers. Further, there can be used those couplers which improve graininess by diffusion of formed dye, and DIR couplers which release a development restrainer upon coupling reaction to bring about edge effect or interlayer effect.

For improving color reproduction in flash photography, it is desirable that a coupler which releases a diffusible type development restrainer (which is inactivated in a developing solution) as described in Japanese Patent Application (OPI) No. 57-151944 is incorporated in at least one unit so that the interlayer effect is adequately obtained.

In order to further strengthen the effect of this invention, i.e. to obtain a color photographic material which provides a picture having better color reproduction independent of photography under any various light sources, it is desirable to regulate spectral sensitivity distribution of each of the blue-, green- and red-sensitive silver halide emulsions within the range as described in U.S. Pat. No. 3,672,898.

Yellow couplers employed in this invention are preferably α-pivaloyl or α-benzoyl acetanilide couplers which have a coupling-off group linked through an oxygen or nitrogen atom. Particularly preferred examples of these two-equivalent couplers include yellow couplers having a coupling-off group linked through an oxygen atom and described in U.S. Pat. Nos. 3,408,194, 3,447,928, 3,933,501 and 4,022,620, and having a coupling-off group linked through a nitrogen atom and described in U.S. Pat. Nos. 3,973,968 and 4,314,023, Japanese Patent Publication No. 58-10739, Japanese Patent Application (OPI i.e. open to public inspection) No. 50-132926, West German Patent Application (OLS) Nos. 2,219,917, 2,261,361, 2,329,587 and 2,433,812. Magenta couplers which can be suitably employed in this invention include 5-pyrazolon couplers, pyrazolo[5,1-c][1,2,4]triazoles described in U.S. Pat. No. 3,725,067 and pyrazole[5,1-b][1,2,4]triazoles described in European Pat. No. 119,860. Two equivalent magenta couplers which are obtained by introducing a coupling-off group through a nitrogen or sulfur atom in a coupling position of four-equivalent couplers are also preferred. As cyan couplers, those which provide cyan dyes resistant to humidity and temperature are preferably used, typical examples of which include phenolic couplers described in U.S. Pat. No. 3,772,002, etc.; 2,5-diacylaminophenolic couplers described in Japanese Patent Application (OPI) Nos. 59-31953, 58-133293 and 59-166956; 2-phenylureido-5-acylamino phenolic couplers described in U.S. Pat. No. 4,333,999, etc.; naphtholic couplers described in Japanese Patent Application No. 59-93605, etc.

Yellow or magenta colored couplers may be used in combination to correct unwanted absorption which appears on the low wavelength side of the main absorption of color developed dye. These couplers can be incorporated in an aqueous medium by emulsifying usually with the aid of high-boiling organic solvent such as phthalates or phosphates having 16 to 32 carbon atoms and, if necessary, a low-boiling organic solvent such as ethyl acetate. These colored couplers are ordinarily used in an amount of 0.01–0.5 mole for yellow coupler, 0.003–0.3 mole for magenta coupler, and 0.002–0.3 mole for cyan coupler per mole of light-sensitive silver halide.

In the emulsion layers of this invention, there may be used any of silver bromide, silver bromoiodide, silver bromochloroiodide, silver chlorobromide and silver chloride. A preferred silver halide is silver bromoiodide or silver bromochloroiodide containing 30 mole % or less of silver iodide. A particularly preferred one is silver bromoiodide containing 2 to 25 mole % of silver iodide.

Silver halide grains in the photographic emulsion may have a regular crystal structure such as a cubic, octahedral or tetradecahedral structure, an irregular crystal structure such as a spherical structure, a crystal structure having crystal defect such as twined crystal surface, or a composite crystal structure.

The size of silver halide grains may be as small as about 0.1 micron or less or as large as about 10 microns in diameter calculated from projected area. The silver halide emulsion employed in this invention may be of monodisperse type having narrow distribution of grain size or of polydisperse type having broad distribution.

Since the subject in flash photography is a human (a figure picture) in many cases, granularity is an important factor from the point of picture quality in flash photography and for this purpose, it is preferred to use monodisperse silver halide emulsion. when monodisperse emulsion is used, it is desirable to use a mixture of two or more emulsions which are different in speed or to construct two or more layers which are different in speed, so that smooth gradation can be realized. The term "monodisperse emulsion" used herein means an emulsion wherein 95% or more of the total number or weight of silver halide grains fall within ±20% of the average grain size.

The photographic emulsion used in this invention can be prepared in any manner, e.g. by the methods as described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). That is, any of an acid process, a neutral process, an ammoniacal process, etc., can be employed.

Soluble silver salts and soluble halogen salts can be reacted by techniques such as a single jet process, a double jet process, or a combination thereof. In addition, there can be used a method in which silver halide grains are formed in the presence of an excess of silver ions (so-called reversal mixing process).

As one system of the double jet process, a so-called controlled double jet process in which the pAg in a liquid phase where silver halide is formed is maintained at a predetermined level can be employed. This process can produce a silver halide emulsion in which the crystal form is regular and the grain size is nearly uniform.

Two or more kinds of silver halide emulsions which are prepared separately may be used as a mixture.

The silver halide emulsion having regular crystal structure can be obtained by controlling pAg and pH during the formation of silver halide grains. Details are described in, e.g., *Photographic Science and Engineering,* Vol. 6, pp 159–165 (1962); *Journal of Photographic Science,* Vol. 12, pp 242–251 (1964), U.S. Pat. No. 3,655,394 and British Pat. No. 1,413,748.

Monodisperse emulsions are described in Japanese Patent Application (OPI) Nos. 48-8600, 51-39027, 51-83097, 53-137133, 54-48521, 54-99419, 58-37635 and 58-49938, Japanese Patent Publication No. 47-11386, U.S. Pat. No. 3,655,394, British Pat. No. 1,413,748, etc.

Tabular grains having an aspect ratio of 5 or more can be employed in this invention. Tabular grains can easily be prepared in a method as described in Cleve, *Photography Theory and Practice* (1930), p. 131; Gutoff, *Photographic Science and Engineering,* Vol. 14, pp 248–257, (1970); U.S. Pat. Nos. 4,434,226, 4,414,310 and 4,433,048 and British Pat. No. 2,112,157. The use of tabular grains improves covering power and color sensitizing efficiency by sensitizing dye, details of which are described in U.S. Pat. No. 4,434,226, supra.

Silver halide grains may have a uniform crystal structure in which the inner and the outer portions differ in halide composition from each other, or may have a layer structure. These silver halide grains are described in, e.g., British Pat. No. 1,027,146, U.S. Pat. Nos. 3,505,068 and 4,444,877 and Japanese Patent Application No. 58-248469. Silver halide grains which are joined to silver halide grains of different compositions or to such compounds as silver rhodanide or lead oxide through epitaxial junction can also be employed. These silver halide grains are described in U.S. Pat. Nos. 4,094,684, 4,142,900, 4,459,353, 4,349,622, 4,395,478, 4,433,501, 4,463,087, 3,656,962 and 3,852,067, British Pat. No. 2,038,792 and Japanese Patent Application (OPI) No. 59-162540, etc. A mixture of various grains of various crystal forms can be employed.

A solvent for silver halides is useful for the acceleration of ripening. It is known, for example, that an excessive amount of halogen ion is contained in a reactor for this purpose. It is therefore apparent that only the introduction of a silver halide solution into the reactor accelerates ripening. Further, other ripening agents can be used. These ripening agents can be added to dispersing media in a reactor before the addition of silver salts and halogen salts, or can be introduced together with one or more halogen salts, silver or a peptizer into a reactor. Alternatively, ripening agents can be introduced prior to the addition of halogen salts and silver salts.

Ripening agents other than halogen ion include ammonia, amines, thiocyanates, e.g., alkali metal thiocyanates, in particular, sodium or potassium thiocyanates and ammonium thiocyanate. The use of thiocyanate ripening agents are described in U.S. Pat. Nos. 2,222,264, 2,448,534 and 3,320,069. Thioether ripening agents conventionally used can also be employed which are described in U.S. Pat. Nos. 3,271,157, 3,574,628 and 3,737,313. Further, thionic compounds as described in Japanese Patent Application (OPI) No. 53-82408 and 53-144319 can be used.

Properties of silver halide grains can be controlled by letting various compounds exist during the precipitation of silver halide grains. These compounds can be present in a reactor from the beginning or can be added together with one or more salts according to a conventional manner. Examples of these compounds are described in U.S. Pat. Nos. 2,448,060, 2,628,167, 3,737,313 and 3,772,031 and *Research Disclosure* Item No. 13452 (June, 1975), and include compounds of copper, iridium, lead, bismuth, cadmium, zinc, sulfur, selenium, tellurium, gold and noble metals of Group VIII of the periodic table. As described in Japanese Patent Publication No. 58-1410 and Moisar, *Journal of Photographic Science,* Vol. 25, (1977), pp 19–27, the interior of silver halide grains can undergo reduction sensitization during the step of grain precipitation.

Silver halide emulsions are usually chemically sensitized. Such chemical sensitization can be coducted using active gelatin as described in T. H. James, *The theory of the photographic process,* 4th ed., MacMillan, (1977), pp 67–76 or in a method as described in *Research Disclosure,* Item No. 12008 (April, 1974); ibid. Vol. 34, (June, 1975), 13452; U.S. Pat. Nos. 2,642,361, 3,297,446, 3,722,031, 3,857,711, 3,901,714, 4,266,018 and 3,904,415 and British Pat. No. 1,315,755, wherein a sensitizing agent such as sulfur, selenium, tellurium, gold, platinum, palladium, iridium or a mixture thereof is used at pAg of 5 to 10, at pH of 5 to 8 and at 30° to 80° C. Chemical sensitization is most suitably conducted in the presence of a gold compound and a thiocyanate compound or in the presence of a sulfur-containing compound such as hypo, thiourea compound or rhodanin compound as described in U.S. Pat. Nos. 3,857,711, 4,266,018 and 4,054,457. Chemical sensitization may be conducted in the presence of auxiliary chemical sensitizer, such as azaindene, azaphridazine or azapyrimidine. It is known that these auxiliary chemical sensitizers restrain fog and increase speed. Examples of these auxiliary chemical sensitizers are described in U.S. Pat. Nos. 2,131,038, 3,411,914 and 3,554,757, Japanese Patent Application (OPI) No. 58-126526 and G. F. Duffin, *Photographic Emulsion Chemistry,* supra. pp. 138–143. In addition to or instead of chemical sensitization, reduction sensitization can be conducted using hydrogen as described in U.S. Pat. Nos. 3,891,446 and 3,984,249, or using a reducing agent such as stannous chloride, thiourea dioxide or polyamine as described in U.S. Pat. Nos. 2,518,698, 2,743,182 and 2,743,183, or by the treatment at lower pAg (e.g. less than 5) and/or at higher pH (e.g. more than 8). Further, spectral sensitization can be increased in a method of chemical sensitization as described in U.S. Pat. Nos. 3,917,485 and 3,966,476.

The photographic emulsion employed in this invention may be spectrally sensitized by a photographic sensitizing dye conventionally used. The emulsion may include a conventional antifoggant or a stabilizer for the purpose of preventing fog formation or of stabilizing photographic performance in the photographic material during the production, storage or photographic processing thereof. Specific examples and the use of such agents are described in U.S. Pat. Nos. 3,954,474 and 3,982,947, Japanese Patent Publication No. 52-28660, *Research Disclosure,* Item No. 17643 (December, 1978), VI A to VI M and E. J. Birr, *Stabilization of Photographic Silver Halide Emulsions,* Focal Press, 1974.

The photographic material of this invention may include as a color fog preventing agent or a color mixing preventing agent, hydroquinones, aminophenols, sulfonamidophenols, etc. The photographic material of this invention may include various color fading preventing agents such as organic compounds, e.g., 5-hydroxycoumarans or spirochromans, or metal complex compounds, e.g., bis-(N,N-dialkyldithiocarbamato) nickel complex.

The photographic material of this invention may include an ultraviolet light absorbing agent such as benzotrizole, typical examples of which are described in *Research Disclosure,* Item No. 24239 (April, 1984).

The photographic material of this invention may contain a filter dye or a water soluble dye in a hydrophilic colloidal layer for the prevention of irradiation or halation or for other purposes.

As a binder for the light-sensitive layer or a backing layer of the photographic material, gelatin, modified gelatins or synthetic hydrophilic polymers can be employed. Any of hydrophilic colloidal layers may contain a hardener such as vinylsulfone derivative and additionally a hardening accelerator such as a vinyl polymer having sulfinic acid salt at the side chain.

The photographic material of this invention may contain one or more surface active agents as coating aids or for other various purposes, e.g., prevention of static mark, improvement of slipping properties, acceleration of emulsification and dispersion, prevention of adhesion, and improvement of photographic properties (e.g., development acceleration, high contrast, or sensitization), etc.

The photographic material of this invention may contain, in addition to the additives described above, various stabilizers, anti-contamination agents, developing agents or precursors thereof, development accelerators or precursors thereof, lubricating agents, mordants, matting agents, antistatic agents, plasticizers or other additives useful for photographic materials. Typical examples of these additives are described in *Research Disclosure,* Item Nos. 17643 (December, 1978) and 18716 (November, 1979).

This invention can be advantageously applied to a high-speed color film for photography comprising a support having provided therein at least two emulsion layers having essentially the same color sensitivity but different speeds. Layer construction is typically in order of, from the support, red-, green- and blue-sensitive layers. Further it is possible to arrange the layers in such a manner that a high-speed layer is interposed between different color-sensitive layers, that is, in a reversed layer arrangement.

The photographic material of this invention is exposed, then treated in a developer comprising an aromatic primary amine color developing agent and then subjected to a conventional processing for removing developed silver. For example, the developed photographic material is processed by one or more steps such as bleaching and fixing, bleach-fixing, or a combination thereof. In these steps, a bleach accelerator such as iodide ion, thiourea compounds, or thiol compounds may be added to the processing solution, if required. After bleach-fixing or fixing, the photographic material is often subjected to water washing which is advantageously conducted in two or more counter-current washing baths so as to economize on water.

The color photographic material of this invention, after it is exposed and color developed, is processed in a bath having mainly bleaching ability and comprising a water-soluble bromide preferably in a concentration of 0.5 to 1.3 mole/l, and a subsequent bath having bleach-fixing ability, so that de-silvering is speeded up and processing time is shortened. Further it is possible to eliminate the disadvantage that the maximum density of cyan color image is lowered.

By the term "a bath having mainly bleaching ability" (hereinafter referred to as simply "bleaching bath") is meant a bath containing a bleaching agent and aiming at bleaching developed silver.

This bleaching bath can bleach at least $\frac{1}{2}$, preferably at least $\frac{2}{3}$, and more preferably at least 4/5 of the maximum amount of developed silver contained in the color photographic material. In addition to bleaching power, it may have de-silvering power which can de-silver only less than $\frac{1}{2}$, preferably less than $\frac{1}{3}$, and more preferably less than 1/5 of the total amount of coated silver of the photographic material.

By the term "a bath having bleach-fixing ability" (hereinafter, referred to as simply "bleach-fixing bath") is meant a bath which can bleach only less than $\frac{1}{2}$, preferably less than $\frac{1}{3}$, and more preferably less than 1/5 of the maximum amount of developed silver contained in the color photographic material, and which can de-silver at least $\frac{1}{2}$, preferably at least $\frac{2}{3}$, and more preferably at least 4/5 of the total amount of coated silver of the photographic material.

Two or more of each of the bleaching and bleach-fixing baths may be used. A washing step (including one in which an amount of washing water is reduced) may be provided between the bleaching and the bleach-fixing baths. A solution overflowing from the bleaching bath when it is replenished may be directly or indirectly, preferably directly, introduced into the subsequent bleach-fixing bath, by which the need to replenish a part or all of the bleaching agent of the bleach-fixing bath can be eliminated.

The water soluble bromide described earlier is a compound which dissolves in the bleaching or bleach-fixing bath and releases a bromide ion. Specific examples include alkali metal bromide such as potassium bromide, sodium bromide or lithium bromide, ammonium bromide, hydrobromic acid, alkaline earth metal bromide such as magnesium bromide, calcium bromide, strontium bromide, etc. Of these, ammonium bromide is particularly preferred.

The bleaching solution contains a bleaching agent in a concentration of 0.1 to 1 mol/l, preferably 0.2 to 0.5 mole/l. The pH of the bleaching solution when it is used is preferably 4.0 to 8.0.

The bleach-fixing solution contains a bleaching agent in a concentration of 0.05 to 0.5 mol/l, preferably 0.1 to 0.3 mole/l and a fixing agent in a concentration of 0.3 to 3 mole/l, preferably 0.5 to 2.5 mole/l, and has a pH of 5 to 8. When the bleaching agent is used in a concentration of less than 0.05 mole/l, both the speed up of the processing and the prevention of reduction in the maximum density of cyan color image cannot be accomplished.

In the de-silvering step, a bleaching accelerator may be added to either or both of the bleaching and the bleach-fixing baths for accelerating the bleaching.

The bleaching accelerator is preferably added to the bleaching bath and can be selected from known bleaching accelerators. Among these, a bleaching accelerator comprising at least one member selected from a compound having a mercapto group or a disulfide linkage, a thiazolidine derivative, a thiourea derivative and an isothiourea derivative accelerates the bleaching to a greater extent as compared not only to the case where the bleaching accelerator is added to the bleaching bath in the prior art bleaching and fixing steps but also to the prior art bleaching bath and de-silvering process, for the reasons unknown.

Such a bleaching accelerator as a compound having a mercapto group or a disulfide linkage as described in Japanese Patent Application (OPI) No. 53-95630, a thiazoline derivative or an isothiourea derivative may be added to the bleaching bath in a concentration of $1\times10^{-5}$ to $10^{-1}$ mole/l, preferably $1\times10^{-4}$ to $5\times10^{-2}$ mole/l, although the concentration may be changed depending upon the kind of photographic material to be processed, the processing temperature, the time for desired processing, etc.

The silver halide color photographic material of this invention may be processed, after development, by a process in which a water washing bath subsequent to a de-silvering step in a bath having fixing ability contains at least one salt selected from sodium or potassium salts of aminocarboxylic acid, aminophosphonic acid, phosphonic acid and phosphonocarboxylic acid, and an amount of a replenisher to the water washing bath is 3 to 50 times amount of a solution taken thereinto from the preceding bath per unit area of the photographic material to be processed.

The bath having fixing ability may comprise two or more baths and may be provided after the bleaching bath, or provided as a bleach-fixing bath, or provided as a bleach-fixing bath after the bleaching bath.

After a fixing or a bleach-fixing step, a processing step such as washing and stabilizing steps are ordinarily provided. However, it is also possible to use a simpler process in which only washing is carried out or stabilization is conducted without substantial washing step. A water-saving washing can also be applied in which all development steps are conducted with washing water being saved and without any particular drainage arrangements.

The water-saving washing bath may contain a chelating agent such as soium or potassium salt of aminopolycarboxylic acid, aminopolyphosphonic acid, polyphosphonic acid or phosphonocarboxylic acid.

The chelating agent cannot only stabilize washing water because of the germicidal activity against bacteria but also bring about unexpected effect, i.e., the prevention of discoloration of cyan color image if sodium or potassium salt in particular is used.

Examples of these chelating agents include an aminopolycarboxylic acid such as ethylenediaminetetraacetic acid or diethylenetriaminepentaacetic acid and, a phosphonic acid such as 1-hydroxyethylidene-1,1-diphosphonic acid or ethylenediamine-N,N,N',N'-tetramethylene phosphonic acid.

The chelating agent such as sodium or potassium salt of aminopolycarboxylic acid is added to washing water in an amount of $1\times10^{-4}$ to $1\times10^{-1}$ mole/l, preferably $5\times10^{-4}$ to $2\times10^{-2}$ mole/l, most preferably $1\times10^{-3}$ to $1\times10^{-2}$ mole/l. Less than $1\times10^{-4}$ mole/l brings about no effects while more than $10^{-1}$ mole/l results in such disadvantages that the salt is precipitated on the film surface of the photographic material after it is dried, scum is deposited on the back surface or on the surface of emulsion layer, or yellow staining increases.

To the washing bath, various compounds may be added for the purpose of prevention of precipitation or stabilization of washing water. For example, there may be added germicide or fungicide for the prevention of propagation of various bacteria, algae or fungi (e.g. compounds as described in J. Antibact. Antifung. Agents, Vol. 11, No. 5, pp 207 to 223 (1983), or in H. Horiguchi, Antibacterial and Antifungal Chemistry), metal salts such as magnesium or aluminum salts, alkali metal salts, ammonium salts, surface active agents for the prevention of unevenness or the reduction of load for drying. Compounds as described in West, *Photographic Science and Engineering*, Vol. 6, pp. 344 to 359 (1965) may also be added. Examples of germicides which can be used include thiazole compounds, isothiazole compounds, halogenated phenols, sulfanylamides, benzotriazoles, etc.

Multistage countercurrent washing step using two or more washing baths (e.g. 2 to 9 baths) can be used to save washing water. Instead of water washing steps, multistage countercurrent stabilizing steps as described in Japanese Patent Application (OPI) No. 57-8543 may be conducted. There can be added to the washing bath, various compounds such as pH control buffer or formalin for stabilizing an image, or surface active agent, fluorescent brightner, hardener, etc. which can be added alone or in combination.

EXAMPLE

To a 3-liter stainless-steel reactor, gelatin (25 g), water (800 m) and 25% ammonia were added and stirred at 800 r.p.m. To this solution, 0.5 mole silver nitrate solution in water and a solution of a mixture of potassium bromine and potassium iodide in water were simultaneously added over a period of 30 minutes while keeping the pAg constant. A solution of 0.001 wt.% $K_2IrCl_6$ in water was added and then 0.5 mole silver nitrate solution in water and a solution of potassium bromide in water were simultaneously added over a period of 30 minutes while keeping the pAg constant.

In the preparation procedures, the temperature, the amount of ammonia, pAg and the amount of an aqueous solution of $K_2IrCl_6$ were changed as shown in Table 1-a and 22 kinds of emulsions as shown in Table 1-b were prepared.

On a cellulose triacetate film which had been coated with a primer layer, each of emulsions EM-A to EM-V (Ag: $2\times10^{-2}$ mole/m$^2$), Coupler C-8 described later ($1.5\times10^{-3}$ mole/m$^2$) and gelatin (2.3 g/m$^2$) were coated. Each of these photographic material was subjected to 1/100 and 1/10,000 second gradation exposure using a exposure system produced by EG & Co. and then developed by the processing procedure as described later. On a sensitometry characteristic curve, (average) gradation (gamma) slope was determined between point a which corresponds to 0.2 density above fog and point b lying 0.5 log units from point a in the direction of greater exposure to obtain G ($10^{-2}$) and G ($10^{-4}$) for 1/100 and 1/10,000 second exposure, respectively.

Values of G ($10^{-4}$)/G ($10^{-2}$) are as shown in Table 1-b.

Some of these emulsions were coated on a cellulose triacetate film support to prepare 5 kinds of multilayer color photographic materials (Samples 101 to 105), the emulsion constitutions of which are as shown in Table 2.

(TABLE 1-a)

| Condition under which each emulsion was prepared | | | | | |
|---|---|---|---|---|---|
| Emulsion | Temperature | Ammonia | First half pAg | Latter half pAg | $K_2IrCl_6$ aqueous solution |
| EM - A | 70° C. | 64 ml | 8.0 | 7.0 | 60 ml |
| B | " | 80 ml | " | 8.3 | " |

(TABLE 1-a)-continued

| Condition under which each emulsion was prepared | | | | | |
|---|---|---|---|---|---|
| Emulsion | Temperature | Ammonia | First half pAg | Latter half pAg | $K_2IrCl_6$ aqueous solution |
| C | 60° C. | 33 ml | 8.3 | 7.2 | 100 ml |
| D | " | " | " | " | — |
| E | " | " | " | " | 120 ml |
| F | " | " | " | " | 60 ml |
| G | 50° C. | 8 ml | 8.6 | 7.3 | 90 ml |
| H | " | " | " | " | — |
| I | " | " | " | " | 120 ml |
| J | " | " | " | " | 40 ml |
| K | 60° C. | 36 ml | 8.3 | 7.2 | 90 ml |
| L | " | " | " | " | — |
| M | 50° C. | 10 ml | 8.6 | 7.3 | 80 ml |
| N | " | " | " | " | — |
| O | 60° C. | 41 ml | 8.3 | 8.6 | 100 ml |
| P | " | " | " | " | 50 ml |
| Q | " | " | " | " | 100 ml |
| R | " | " | " | " | — |
| S | 50° C. | 12 ml | 8.6 | 8.9 | 100 ml |
| T | " | " | " | " | 20 ml |
| U | " | " | " | " | 40 ml |
| V | " | " | " | " | — |

(TABLE 1-b)

| Outline of each emulsion | | | | |
|---|---|---|---|---|
| Emulsion | Average grain size in diameter | Crystal habit | Silver halide included | G ($10^{-4}$)/ G ($10^{-2}$) |
| EM - A | about 0.8 μm | cubic | 6 mole % | 0.99 |
| B | 1.0 | octa-hedral | 10 | 0.97 |
| C | 0.5 | cubic | 4 | 1.01 |
| D | " | " | " | 0.92 |
| E | " | " | " | 1.02 |
| F | " | " | " | 0.97 |
| G | 0.25 | " | " | 1.00 |
| H | " | " | " | 0.89 |
| I | " | " | " | 1.02 |
| J | " | " | " | 0.95 |
| K | 0.5 | " | " | 1.00 |
| L | " | " | " | 0.93 |
| M | 0.25 | " | " | 0.98 |
| N | " | " | " | 0.92 |
| O | 0.6 | octa-hedral | 8 | 1.01 |
| P | " | octa-hedral | " | 0.96 |
| Q | " | octa-hedral | " | 0.99 |
| R | " | octa-hedral | " | 0.93 |
| S | 0.3 | octa-hedral | 6 | 1.00 |
| T | " | octa-hedral | " | 0.93 |
| U | " | octa-hedral | " | 0.95 |
| V | " | octa-hedral | " | 0.87 |

COMPOSITION OF LIGHT-SENSITIVE LAYER

Coated amount is expressed in gram of silver/$m^2$ for silver halides and colloidal silver and gram/$m^2$ for couplers, additives and gelatin. As for a sensitizing dye, it is expressed in mole per mole of silver contained in the layer in which the sensitizing dye is contained.

| 1st layer: Antihalation layer | |
|---|---|
| Black colloidal silver | 0.2 |
| Gelatin | 1.3 |
| UV-1 (ultraviolet ray absorber) | 0.1 |
| UV-2 (ultraviolet ray absorber) | 0.2 |

-continued

| | |
|---|---|
| OIL-1 (dispersing oil) | 0.01 |
| OIL-2 (dispersing oil) | 0.01 |
| **2nd layer: Interlayer** | |
| Fine grain size silver halide (AgBr: average grain size of 0.07 micron) | 0.15 |
| Gelatin | 1.0 |
| C-1 (colored coupler) | 0.1 |
| C-2 (colored coupler) | 0.01 |
| OIL-1 | 0.1 |
| **3rd layer: First red-sensitive layer** | |
| Silver bromoiodide emulsion (average grain size of 0.3 micron, AgBrI containing 3 mole % AgI) | 1.6 |
| Gelatin | 1.6 |
| Sensitizing dye I | $4.5 \times 10^{-4}$ |
| Sensitizing dye II | $1.5 \times 10^{-4}$ |
| C-3 (coupler) | 0.30 |
| C-4 (coupler) | 0.40 |
| C-5 (coupler) | 0.02 |
| C-2 (coupler) | 0.003 |
| OIL-1 | 0.03 |
| OIL-2 | 0.012 |
| **4th layer: Second red-sensitive layer** | |
| Silver bromoiodide emulsion (average grain size of 0.7 micron, AgBrI containing 6 mole % of AgI) | 1.0 |
| Gelatin | 1.0 |
| Sensitizing dye I | $3 \times 10^{-4}$ |
| Sensitizing dye II | $1 \times 10^{-4}$ |
| C-6 (coupler) | 0.05 |
| C-7 (coupler) | 0.015 |
| C-2 (coupler) | 0.01 |
| OIL-1 | 0.01 |
| OIL-2 | 0.05 |
| **5th layer: Interlayer** | |
| Gelatin | 1.0 |
| Cpd-A | 0.03 |
| OIL-1 | 0.05 |
| OIL-2 | 0.05 |
| **6th layer: First green-sensitive layer** | |
| Silver bromoiodide emulsion (average grain size of 0.3 micron, AgBrI containing 4 mole % AgI) | 0.8 |
| Gelatin | 1.0 |
| Sensitizing dye III | $5 \times 10^{-4}$ |
| Sensitizing dye IV | $2 \times 10^{-4}$ |
| C-8 (coupler) | 0.3 |
| C-5 (coupler) | 0.06 |
| C-1 (coupler) | 0.15 |
| OIL-1 | 0.5 |
| **7th layer: Second green-sensitive layer** | |
| Silver bromoiodide emulsion (average grain size of 0.7 micron, AgBrI containing 6 mole % AgI) | 0.85 |
| Gelatin | 1.0 |
| Sensitizing dye III | $3.5 \times 10^{-4}$ |
| Sensitizing dye IV | $1.4 \times 10^{-4}$ |
| C-10 (coupler) | 0.05 |
| C-11 (coupler) | 0.01 |
| C-12 (coupler) | 0.08 |
| C-1 (coupler) | 0.02 |
| C-9 (coupler) | 0.02 |
| OIL-1 | 0.10 |
| OIL-2 | 0.05 |
| **8th layer: Yellow filter layer** | |
| Yellow colloidal silver | 0.08 |
| Gelatin | 1.2 |
| Cpd-B | 0.1 |
| OIL-1 | 0.3 |
| **9th layer: First blue-sensitive layer** | |
| Monodisperse silver bromoiodide emulsion (average grain size of 0.3 micron, AgBrI containing 4 mole % AgI) | 0.4 |
| Gelatin | 1.0 |
| Sensitizing dye V | $2 \times 10^{-4}$ |
| C-13 (coupler) | 0.9 |
| C-5 (coupler) | 0.0 |
| OIL-1 | 0.2 |
| **10th layer: Second blue-sensitive layer** | |
| Silver bromoiodide emulsion (average | 0.5 |

-continued

| | |
|---|---|
| grain size of 1.5 microns, AgBrI containing 10 mole % AgI) | |
| Gelatin | 0.6 |
| Sensitizing dye V | $1 \times 10^{-4}$ |
| C-14 (coupler) | 0.25 |
| OIL-1 | 0.07 |
| 11th layer: First protective layer | |
| Gelatin | 0.8 |
| UV-1 (ultraviolet ray absorber) | 0.1 |
| UV-2 (ultraviolet ray absorber) | 0.2 |
| OIL-1 | 0.01 |
| OIL-2 | 0.01 |
| 12th layer: Second protective layer | |

-continued

| | |
|---|---|
| Fine grain size silver bromide (average grain size of 0.07 micron) | 0.5 |
| Gelatin | 0.45 |
| Polymethylmethacrylate particles (diameter of 1.5 microns) | 0.2 |
| H-1 (hardener) | 0.4 |
| S-1 (formaldehyde scavenger) | 1.0 |

In addition to the above components, a surface active agent was added as coating aids to each of the layers.

The compounds used in the above Example are as follows:

UV - 1

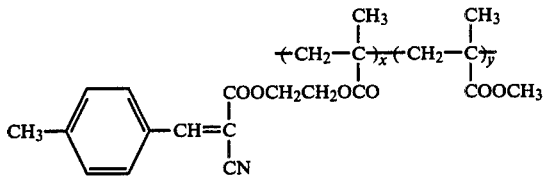

x/y = 7/3 (by weight)

UV - 2

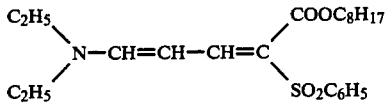

Tricresyl phosphate — Oil - 1

Dibutyl phthalate — Oil - 2

Bis(2-ethylhexyl) phthalate — Oil - 3

C - 1

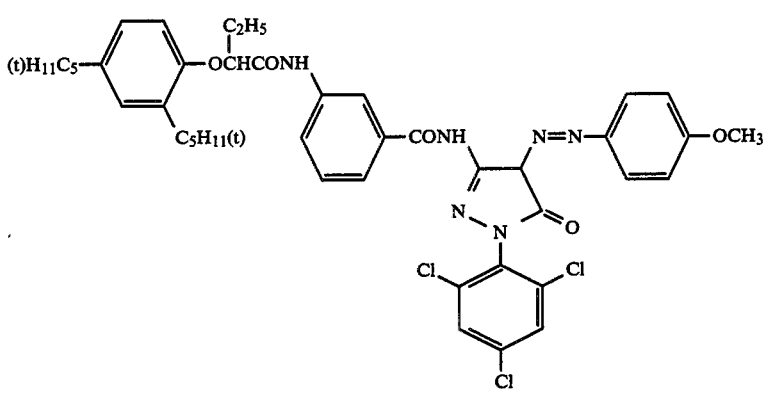

C - 2

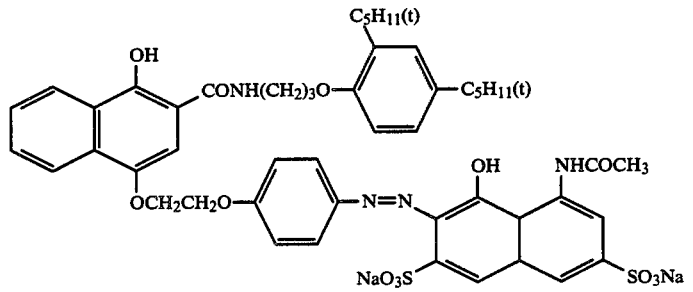

C - 3

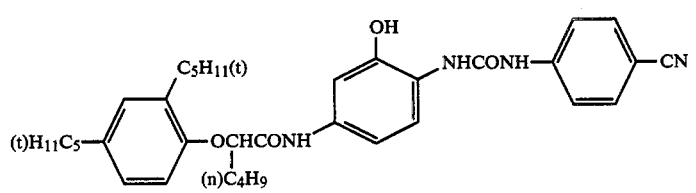

-continued
C - 4
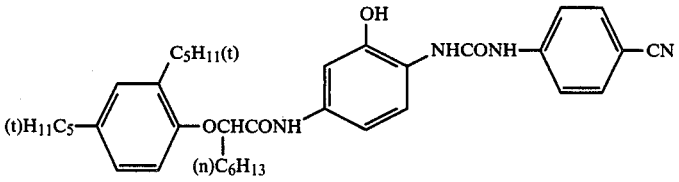
C - 5
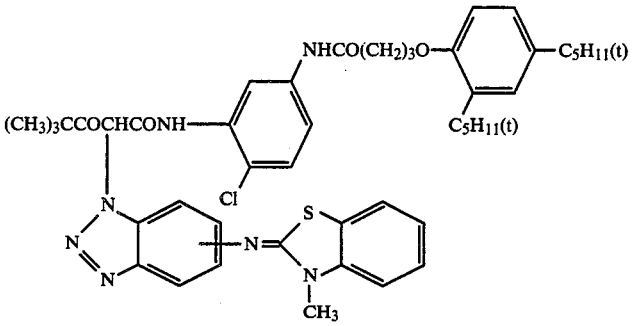
C - 6
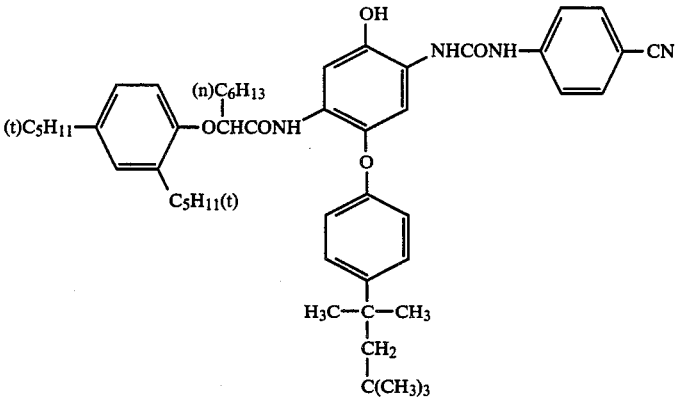
C - 7
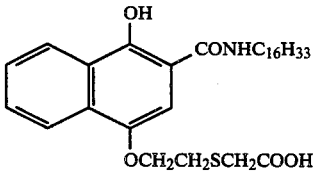
C - 8
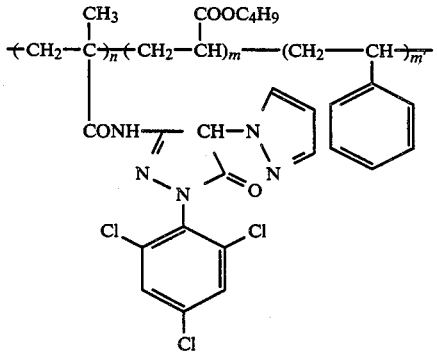
n/m + m' = 1 (by weight)
m/m' = 1 (by weight)
Molecular Weight about 20,000

-continued
C - 9
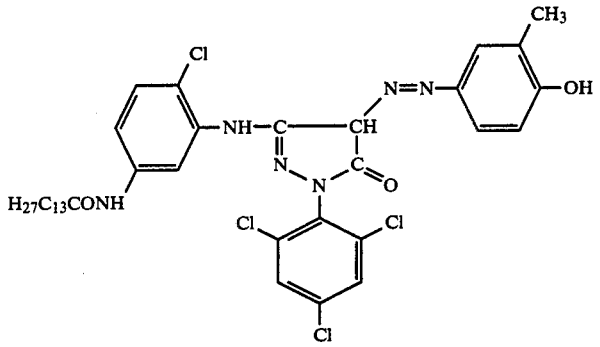
C - 10
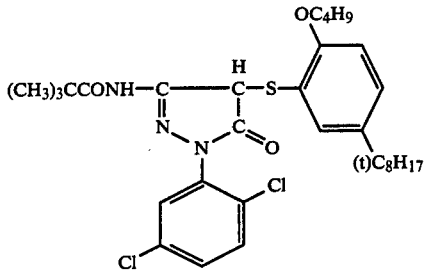
C - 11
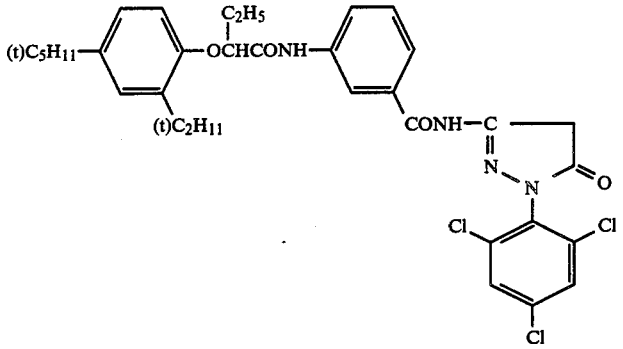
C - 12
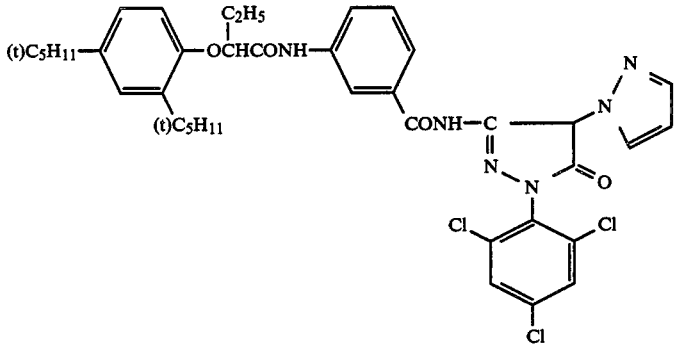
C - 13
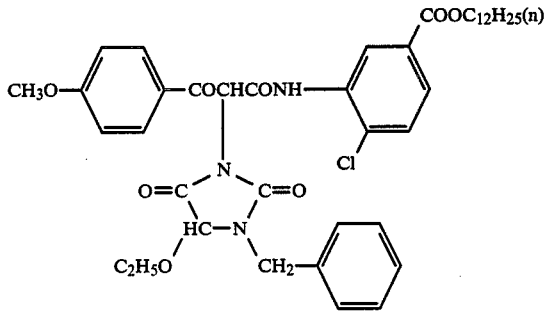

-continued
Cpd A
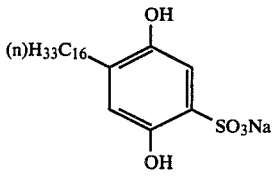
Cpd B
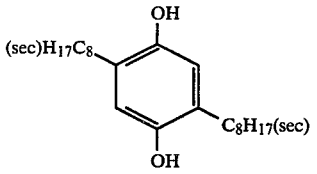
Sensitizing dye I
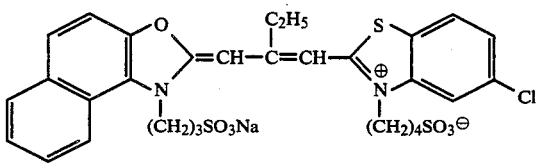
Sensitizing dye II
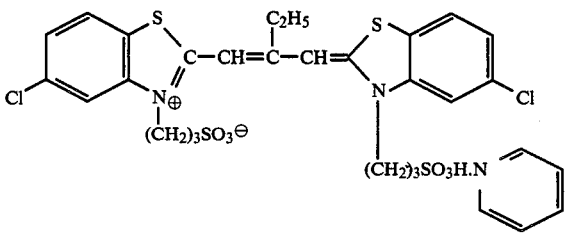
Sensitizing dye III
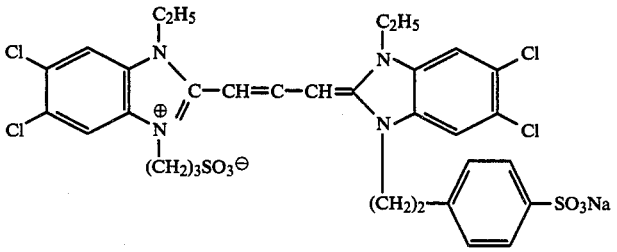
Sensitizing dye IV
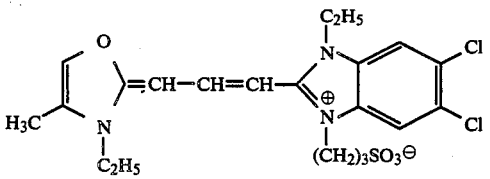
Sensitizing dye V
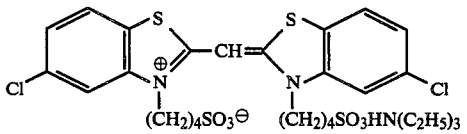
H - 1
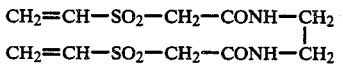
S - 1
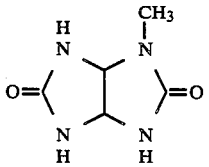
Samples obtained were subjected to 1/100 and 1/10,000 second gradation exposure using the exposure

| | |
|---|---|
| Color development | 3 min. 15 sec. |
| Bleaching | 6 min. 30 sec. |
| Water washing | 2 min. 10 sec. |
| Fixing | 4 min. 20 sec. |
| Water washing | 3 min. 15 sec. |
| Stabilizing | 1 min. 5 sec. |

The compositions of the processing liquids used in the steps were as follows:

| | |
|---|---|
| Color developing solution | |
| Diethylenetriamine pentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N—ethyl-N—beta-hydroxyethylamino)-2-methylaniline sulfate | 4.5 g |
| Water to | 1.0 l |
| | pH 10.0 |
| Bleaching solution | |
| Ethylenediaminetetraacetic acid ferric ammonium salt | 100.0 g |
| Ethylenediaminetetraacetic acid disodium salt | 10.0 g |
| Ammonium bromide | 150.0 g |
| Ammonium nitrate | 10.0 g |
| Water to | 1.0 l |
| | pH 6.0 |
| Fixing solution | |
| Ethylenediaminetetraacetic acid disodium salt | 1.0 g |
| Sodium sulfite | 4.0 g |
| Ammonium thiosulfate aqueous solution (70%) | 175.0 ml |
| Sodium bisulfite | 4.6 g |
| Water to | 1.0 l |
| | pH 6.6 |
| Stabilizing solution | |
| Formalin (40%) | 2.0 ml |
| Polyoxyethylene-p-mono-nonylphenylether (average degree of polymerization of about 10) | 0.3 g |
| Water to | 1.0 l |

TABLE 2

Emulsion composition

| Layer | Sample 101 | 102 | 103 | 104 | 105 |
|---|---|---|---|---|---|
| First red-sensitive layer | C/G | D/H | E/I | F/J | E/H |
| Second red-sensitive layer | A | A | A | A | A |
| First green-sensitive layer | K/M | L/N | K/M | L/N | K/N |
| Second green-sensitive layer | A | A | A | A | A |
| First blue-sensitive layer | O/S | P/T | Q/U | R/V | P/T |
| Second blue-sensitive layer | B | B | B | B | B |

First red-, first green- and first blue-sensitive layers contain each a mixed emulsion of two kinds emulsions in a silver halide ratio of 1/1.

Each of these samples was loaded in a compact camera with a built-in flash (CANON AUTOBOY (trademark) produced by CANON). A picture of a person holding a gray plate was taken under the following two conditions.

Condition (a)

Daylight at noon in fine weather in fall (color temperature of about 5500 K.), 1/100 second exposure.

Condition (b)

Night, flash light, 1/8,000 second exposure.

The exposed negative film was developed. The negative image thus obtained was printed on a color paper using an AUTO PRINTER FAP 3500 manufactured by FUJI PHOTO FILM CO., LTD. Conditions under which the printing was carried out were adjusted for each sample so that the gray plate which was held up by the person and which was taken under the photographic condition (a) became gray on a print. The ratio of gradation at 1/10,000 second exposure to that at 1/100 second exposure for each sample was determined by exposure through an optical wedge and shown in Table 3. Each sample was loaded in the camera with a built-in flash and a picture was taken by flash photography. The practical print thus obtained was visually evaluated by ten panelists (a) to (j) who engaged in evaluation of color prints, regarding color reproduction and tone reproduction and graded in five ranks:

1 . . . inferior
2 . . . somewhat inferior
3 . . . average
4 . . . superior
5 . . . very superior Points given by each panelist and total points for each sample are shown in Table 3.

Figure 3:
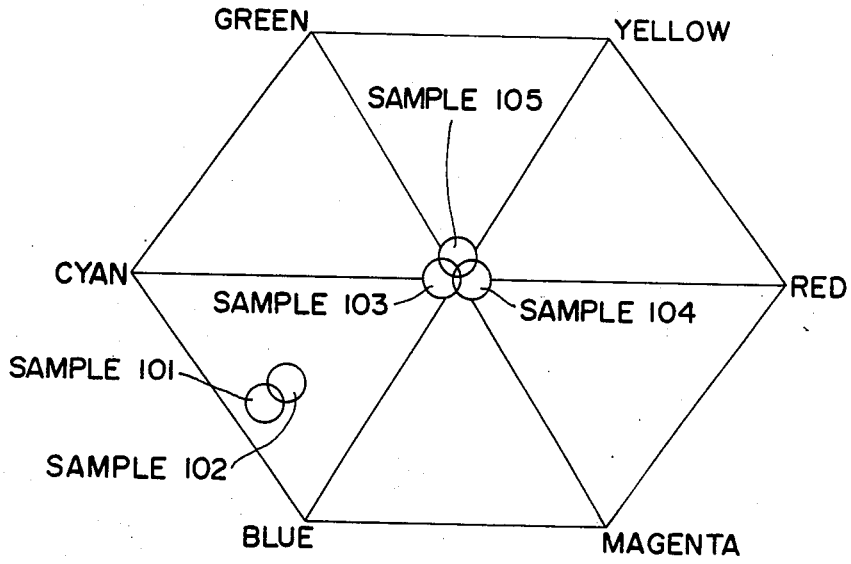

FIG. 3 shows color balance of a gray plate on a print obtained by flash photography of the gray plate using each photographic sample.

Table 3 and FIG. 3 show that only samples of this invention provided images having real tone reproduction and natural color reproduction by flash photography.

Color balance was determined as follows: Each of yellow, magenta and cyan color densities of the area which was reproduced on the print and which corresponded to 0.7 of the optical density on the Macbeth chart was measured by the Macbeth densitometer. Each difference between yellow, magenta or cyan color density and the average density of these three color densities was plotted on hexagonal coordinates to obtain color balance. The center of the hexagonal coordinates shows neutral gray and the six apexes show yellow, magenta, cyan, blue, red, and green, respectively, which deviate from neutral gray by 0.2 in optical density.

TABLE 3

Gradation and evaluation for practical print by a flash photography

| | | Sample-101 Comparative Example | Sample-102 Comparative Example | Sample 103 Comparative Example | Sample-104 This Invention | Sample-105 This Invention |
|---|---|---|---|---|---|---|
| Gradation | $\gamma_B(10^{-4})/\gamma_B(10^{-2})$ | 1.00 | 0.94 | 0.97 | 0.91 | 0.94 |
| | $\gamma_G(10^{-4})/\gamma_G(10^{-2})$ | 0.99 | 0.93 | 0.99 | 0.93 | 0.96 |
| | $\gamma_R(10^{-4})/\gamma_R(10^{-2})$ | 1.00 | 0.94 | 1.01 | 0.95 | 0.98 |
| Total evaluation | Color reproduction (color balance) | cyanish and bluish, unnatural | cyanish and bluish, unnatural | natural | natural | natural |
| | Tone reproduction | bad | very good | bad | very good | good |

TABLE 3-continued

| | | | Gradation and evaluation for practical print by a flash photography | | | | |
|---|---|---|---|---|---|---|---|
| | | | Sample-101 Comparative Example | Sample-102 Comparative Example | Sample 103 Comparative Example | Sample-104 This Invention | Sample-105 This Invention |
| | | | (person's face blew out) | | (person's face blew out) | | |
| indi-vidual evalu-ation | a | (Color reproduction, tone reproduction) | 2, 3 | 2, 4 | 4, 3 | 5, 5 | 5, 5 |
| | b | (Color reproduction, tone reproduction) | 2, 3 | 3, 5 | 4, 4 | 5, 5 | 4, 4 |
| | c | (Color reproduction, tone reproduction) | 2, 3 | 2, 5 | 4, 3 | 5, 5 | 5, 3 |
| | d | (Color reproduction, tone reproduction) | 2, 3 | 2, 5 | 4, 3 | 5, 5 | 4, 4 |
| | e | (Color reproduction, tone reproduction) | 2, 3 | 2, 4 | 5, 3 | 4, 4 | 4, 4 |
| | f | (Color reproduction, tone reproduction) | 2, 2 | 2, 5 | 5, 3 | 4, 5 | 4, 4 |
| | g | (Color reproduction, tone reproduction) | 2, 3 | 2, 4 | 4, 3 | 5, 4 | 5, 4 |
| | h | (Color reproduction, tone reproduction) | 2, 3 | 2, 4 | 4, 2 | 5, 5 | 5, 4 |
| | i | (Color reproduction, tone reproduction) | 2, 3 | 3, 5 | 4, 3 | 4, 4 | 5, 4 |
| | j | (Color reproduction, tone reproduction) | 2, 2 | 2, 4 | 5, 3 | 5, 4 | 5, 4 |
| | Total | (Color reproduction, tone reproduction) | 20, 28 | 22, 45 | 43, 30 | 47, 46 | 46, 40 |

As seen from the foregoing, the color photographic material of this invention can provide a color picture having excellent color and tone reproduction both in regular and flash photography.

What we claim is:

1. A silver halide color photographic material which comprises a support having coated thereon at least one blue-sensitive silver halide emulsion layer, at least one green-sensitive silver halide emulsion layer and at least one red-sensitive silver halide emulsion layer, characterized in that the gradation of each of the blue-, green- and red-sensitive layers satisfies the following relation:

$$\frac{\gamma_B(10^{-4})}{\gamma_B(10^{-2})} < \frac{\gamma_G(10^{-4})}{\gamma_G(10^{-2})} \leqq \frac{\gamma_R(10^{-4})}{\gamma_R(10^{-2})} < 0.99$$

wherein $\gamma_B(10^{-4})$, $\gamma_G(10^{-4})$ and $\gamma_R(10^{-4})$ represent gradation of the blue-, green- and red-sensitive layers upon 1/10,000 second exposure, respectively and $\gamma_B(10^{-2})$, $\gamma_G(10^{-2})$ and $\gamma_R(10^{-2})$ represent those upon 1/100 second exposure, respectively.

2. The silver halide color photographic material as claimed in claim 1, wherein the ratio $\gamma_G(10^{-4})/\gamma_G(10^{-2})$ is less than the ratio $\gamma_R(10^{-4})/\gamma_R(10^{-2})$.

3. The silver halide color photographic material as claimed in claim 1, wherein the ratio of gradation of each of the blue-, green- and red-sensitive layers upon 1/10,000 second exposure to those upon 1/100 second exposure respectively satisfies the following relation:

$$0.85 < \gamma_B(10^{-4})/\gamma_B(10^{-2}) < 0.96$$

$$0.87 < \gamma_G(10^{-4})/\gamma_G(10^{-2}) < 0.98$$

$$0.89 < \gamma_R(10^{-4})/\gamma_R(10^{-2}) < 0.99$$

4. The silver halide color photographic material as claimed in claim 1, wherein the ratio of gradation of each of the blue-, green- and red-sensitive layers upon 1/10,000 second exposure to those upon 1/100 second exposure respectively satisfies the following relation:

$$0.87 < \gamma_B(10^{-4})/\gamma_B(10^{-2}) < 0.92$$

$$0.89 < \gamma_G(10^{-4})/\gamma_G(10^{-2}) < 0.94$$

$$0.91 < \gamma_R(10^{-4})/\gamma_R(10^{-2}) < 0.96$$

5. The silver halide color photographic material as claimed in claim 1, wherein the ratio of gradation of each of the blue-, green- and red-sensitive layers upon 1/10,000 second exposure to those upon 1/100 second exposure satisfies the following relation:

$$0.92 < \frac{\gamma_B(10^{-4})}{\gamma_B(10^{-2})} / \frac{\gamma_G(10^{-4})}{\gamma_G(10^{-2})} < 0.99$$

$$1.01 < \frac{\gamma_R(10^{-4})}{\gamma_R(10^{-2})} / \frac{\gamma_G(10^{-4})}{\gamma_G(10^{-2})} < 1.08.$$

6. The silver halide color photographic material as claimed in claim 1, wherein the ratio of gradation of each of the blue-, green- and red-sensitive layers upon 1/10,000 second exposure to those upon 1/100 second exposure respectively satisfies the following relation:

$$0.95 \frac{\gamma_B(10^{-4})}{\gamma_B(10^{-2})} / \frac{\gamma_G(10^{-4})}{\gamma_G(10^{-2})} < 0.98$$

$$1.02 \frac{\gamma_R(10^{-4})}{\gamma_R(10^{-2})} / \frac{\gamma_G(10^{-4})}{\gamma_G(10^{-2})} < 1.05.$$

7. The silver halide color photographic material as claimed in claim 1, wherein the silver halide emulsion is of monodispose type wherein 95% or more of the total number or weight of silver halide grains fall within ±20% of the average grain size.

* * * * *